United States Patent [19]

Mehta

[11] Patent Number: 4,582,433

[45] Date of Patent: Apr. 15, 1986

[54] ROTARY PROCESSORS AND METHODS FOR LIQUID-LIQUID EXTRACTION

[75] Inventor: Pradip S. Mehta, Corpus Christi, Tex.

[73] Assignee: USM Corporation, Flemington, N.J.

[21] Appl. No.: 685,054

[22] Filed: Dec. 20, 1984

[51] Int. Cl.[4] ..... B01F 7/10

[52] U.S. Cl. ..... 366/76; 366/99; 366/307

[58] Field of Search ..... 159/2 E; 210/360.1, 210/378, 799; 264/176 C, 349; 366/75, 76, 77, 96, 97, 98, 99, 136, 137, 184, 191, 194, 195, 196, 262, 263, 264, 265, 302, 303, 304, 305, 307, 315, 348, 349; 425/203, 206, 207, 224, 376 B

[56] References Cited

U.S. PATENT DOCUMENTS

| | | | |
|---|---|---|---|
| 3,082,816 | 3/1963 | Skidmore | 159/49 |
| 3,267,075 | 8/1966 | Schnell | 260/47 |
| 3,799,234 | 3/1974 | Skidmore | 159/2 E |
| 3,963,558 | 6/1976 | Skidmore | 159/2 E |
| 4,142,805 | 3/1979 | Tadmor | 366/97 |
| 4,194,841 | 3/1980 | Tadmor | 366/75 |
| 4,207,004 | 6/1980 | Hold et al. | 366/97 |
| 4,213,709 | 7/1980 | Valsamis | 366/76 |
| 4,227,816 | 10/1980 | Hold et al. | 366/99 |
| 4,255,059 | 3/1981 | Hold et al. | 366/97 |
| 4,289,319 | 9/1981 | Hold et al. | 366/97 |
| 4,300,842 | 11/1981 | Hold et al. | 366/99 |
| 4,329,065 | 5/1982 | Hold et al. | 366/97 |
| 4,389,119 | 6/1983 | Valsamis et al. | 366/99 |
| 4,402,616 | 9/1983 | Valsamis et al. | 366/99 |
| 4,411,532 | 10/1983 | Valsamis et al. | 366/99 |
| 4,413,913 | 11/1983 | Hold et al. | 366/75 |
| 4,421,412 | 12/1983 | Hold et al. | 366/76 |
| 4,448,537 | 5/1984 | Sugimori et al. | 366/75 |
| 4,480,923 | 11/1984 | Mehta | 366/99 |
| 4,486,099 | 12/1984 | Tadmor | 366/99 |

FOREIGN PATENT DOCUMENTS 1144184 3/1969 United Kingdom .

*Primary Examiner*—Robert W. Jenkins

*Attorney, Agent, or Firm*—Thomas S. Szatkowski

[57] ABSTRACT

Rotary processors and methods for purifying a viscous liquid material by liquid-liquid extraction. Material is introduced to an extracting apparatus including a mixing rotary processor comprising at least one annular channel carried by a rotor and enclosed by a housing to form a mixing passage. The material is dragged forward by the rotating channel from the passage inlet past a blocking member. Solvent introduced to the passage, such as by spray means, is carried downstream with the material and dispersed in material collected at a passage end wall. In one embodiment the blocking member comprises a spreader which spreads the material as films on the channel walls. In another embodiment, sparging means sparges solvent into a pool of the material collected upstream of the blocking member. Separation of the solvent from the material may involve rotary devolatilizing or phase separating processors, which may be arranged with the mixing processor for cocurrent or countercurrent, multi-stage series operation.

23 Claims, 8 Drawing Figures

ROTARY PROCESSORS AND METHODS FOR LIQUID-LIQUID EXTRACTION

THE FIELD OF THE INVENTION

This invention relates to novel methods and apparatus for processing viscous materials and particularly to rotary processors for removing dissolved impurities from a viscous material by liquid-liquid extraction.

DESCRIPTION OF THE PRIOR ART

Rotary processors are known to the art. Details relating to such processors are described in U.S. Pat. Nos. 4,142,805; 4,194,841; 4,207,004; 4,213,709; 4,227,816; 4,255,059; 4,289,319; 4,300,842; 4,329,065; 4,389,119, 4,402,616; 4,411,532; 4,413,913; 4,421,412 and in commonly assigned, copending U.S. patent applications Ser. Nos. 532,156; 532,157; 532,162; 532,165 and 532,166, all filed Sept. 14, 1983.

Essential elements of the basic individual processing passage of rotary processors disclosed in the above patents and applications comprise a rotatable element carrying at least one processing channel and a stationary element providing a coaxial closure surface forming with the channel an enclosed processing passage. The stationary element provides a feed inlet and a discharge outlet for the passage. A stationary blocking member near the outlet provides an end wall surface to block movement of material fed to the passage and to coact with the moving channel walls to establish relative movement between the blocked material and the moving channel walls. This coaction permits material in contact with the moving walls to be dragged forward to the end wall surface for collection and/or controlled processing, e.g. mixing and pressurization and discharge. As disclosed in the above patents and applications, the processing passages present a highly versatile processing capability.

U.S. Pat. No. 4,421,412 discloses apparatus for melting particulate materials, and includes means for improving mixing of melted and unmelted material to increase the melting efficiency of the processor. U.S. Pat. Nos. 4,142,805 and 4,194,841 disclose in one embodiment apparatus and methods providing a mixing dam extending part way into the channel between the inlet and the outlet to improve mixing by increasing the shearing action on the material in the passage. A port may be provided through the housing downstream of the dam to remove material from or add material to a void created downstream of the dam. However, none of these patents discloses or claims apparatus or methods for removing dissolved impurities from a viscous material by liquid-liquid extraction.

U.S. Pat. Nos. 4,227,816; 4,213,709; 4,389,119; 4,402,616 and 4,411,532 relate to multi-stage rotary processors which include a plurality of processing stages, each having one or more processing passages. Material transfer passages or grooves are formed in the closure surface of the stationary element and arranged to transfer material from a passage (or passages) of one stage to a passage (or passages) of the same or another stage. These multi-stage processors may be arranged to combine in series two or more processing steps, such as melting, mixing and pumping or other combinations of processing steps.

U.S. Pat. Nos. 4,255,059; 4,329,065 and 4,413,913 relate to apparatus and methods for devolatilizing viscous materials by spreading the material as thin films on the sides of the rotating channel walls so that volatile materials can be withdrawn from the surfaces of the thin films. Application Ser. Nos. 532,162 and 532,166 disclose apparatus and methods for foam devolatilizing of viscous materials involving feeding the material to the processing passage, inducing foaming by formation of bubbles of volatiles and non-pressurizing shearing to release the volatiles for removal from the the passage. Application Ser. No. 532,156 discloses a vacuum system for use with either film or foam devolatilizers. Application Ser. Nos. 532,157 and 532,165 disclose sealing means to control leakage of pressure (e.g. while operating under high vacuum) and material between processing passages at different pressure levels. U.S. Pat. Nos. 4,207,004; 4,289,319 and 4,300,842 disclose rotary processor seals to resist flow of liquid material into the clearance between the housing and the rotor.

British Pat. No. 1,144,184 describes and claims a device for making briquettes from raw cement slurry. A hollow drum, perforated on its periphery and carrying radial flanges defining annular channels, rotates within a casing to carry the slurry from an inlet to an extrusion die. A scraper removes slurry from the drum and directs it toward the die. The continuous rotation of the drum builds up pressure upstream of the extrusion die, compacting the solids and forcing the slurry water out through the perforated drum. In a preferred embodiment, water removal is aided by evacuation of the drum interior. The compacted solids are extruded through the die as briquettes. This apparatus, however, is specifically designed to process crude liquid-solid mixtures and to effect minimal separation—that is to remove only enough water to permit the formation of briquettes from the compacted solids.

U.S. Pat. No. 4,448,537 discloses a screw extruder having a hydro-extracting section formed with doughnut shaped plates and having slits between adjacent plates. Raw material comprising resin in particulate, solid form mixed with relatively large quantities of liquid, such as are formed by polymerization in an aqueous system, are fed to the hydro-extracting section for removal of most of the liquid from the solid resin before melting conventionally in a downstream section of the extruder. Any remaining liquid must be removed by heating and venting in a devolatilizing step. In the hydro-extracting section, the action of the rotating screw compacts the resin particles and forces the water out through the slits between the plates. The compacted, partially dried solids are then carried downstream to the melting section of the extruder. Neither the British patent nor the '537 patent discloses rotary processors or methods for removing dissolved impurities from viscous materials by liquid-liquid extraction.

U.S. Pat. No. 3,267,075 discloses a method for removing solvents used in the production of polycarbonates to obtain pure polycarbonate from a dilute solution containing from about 2% to about 30–40% polycarbonate. The method comprises heating the dilute solution to at least the boiling point of the solvent, volatilizing a portion of the solvent, mixing with the remaining solution a chemically inert material having a boiling point below the decomposition temperature of the polycarbonate and heating this mixture to volatilize the remaining solvent and impurities. The polycarbonate may then be extruded as a purified product. In a preferred embodiment, these steps are carried out in a single multi-section screw extruder. This method however requires the use of bulky equipment to purify the polycarbonate, and would be unsuitable for temperature sensitive materials.

U.S. Pat. Nos. 3,799,234 and 3,963,558 disclose apparatus and methods for removing dissolved solvent from polymers in multi-stage screw extruder-devolatilizers. U.S. Pat. No. 3,799,234 discloses a sealed stage of the extruder for injecting a gas such as steam for countercurrent flow to strip volatile components from the polymer, the major portion of the injected gas being removed upstream of the point of injection. Also disclosed in the patent is a provision for injecting water into the material to cool the polymer at a point downstream of a pressure seal isolating the upstream injection section. This water is removed as a vapor through an additional vent positioned between the water injection point and the steam injection section. U.S. Pat. No. 3,963,558 discloses as one of the final steps in purifying the polymer, introducing for countercurrent flow a stripping fluid which is removed as a vapor upstream of the introduction point. More than one fluid injection section may be provided, each section being separated by a pressure seal. The apparatus and methods of both of these patents, however, require multi-section screws of extensive lengths as well as high energy input for rotating the lengthy screw and for preheating and devolatilizing the materials.

This invention presents to the art novel rotary processors and methods for simply and efficiently removing dissolved impurities from a viscous material by liquid-liquid extraction.

SUMMARY OF THE INVENTION

The novel apparatus and methods of this invention involve extracting impurities from a viscous liquid material by liquid-liquid extraction, mixing to disperse within the material a solvent which will preferentially dissolve, extract or otherwise partition one or more of the impurities, and separating the solvent carrying the dissolved impurities from the mixture. This two-stage process of dispersion and separation involves: (1) dispersion means to which viscous material and solvent liquid are separately introduced for mixing and extraction and from which a heterogeneous mixture of viscous material and solvent is discharged, and (2) separating means which receives the mixture discharged from the dispersion means, separates the solvent from the viscous material and separately discharges the solvent and the purified viscous material. The dispersing means of the present invention comprises a rotary mixing processor comprising one or more annular channels carried by a rotor and enclosed by a housing to form mixing passages. Each passage has an inlet, a member providing a passage end wall spaced apart from the inlet, an outlet near the end wall, a blocking member positioned between the inlet and the end wall and means at or near the blocking member for introducing solvent liquid to the passage. Viscous liquid material fed to the inlet is dragged forward by the rotating side walls of the channel past the blocking member and toward the end wall for collection as a recirculating pool, mixing, pressurizing and discharge from the passage. Solvent liquid is introduced to the passage at or near the blocking member and is carried with the viscous material toward the end wall to be dispersed in the viscous material.

In one embodiment, the blocking member of each mixing passage provides a spreader to spread viscous material on the rotating side walls as films. Spray means are provided at or near the spreader to introduce solvent to the passage by spraying the solvent on the films of material. In another embodiment, the blocking member blocks and collects some of the material as an upstream pool. Sparging means at or near the blocking member introduces solvent to the passage by sparging the solvent into the upstream pool of material.

Preferred separating means include devolatilizing rotary processors or phase separating rotary processors, any of which may be arranged with the mixing processor to provide single- or multi-stage extracting apparatus. Cocurrent or countercurrent flow of solvent and viscous material may by provided. In another embodiment, the extracting apparatus comprises mixing passages and separating passages provided by a common rotor and enclosed by a common housing.

Solvents selected for extracting impurities from the viscous material must be substantially inert with respect to the viscous material. The solvent is introduced in a proportion relative to the viscous material sufficient to remove at least a portion of the impurities. Additionally, the properties of the solvent selected should relate to the separating means used. For example, if separation is to be carried out in a devolatilizing rotary processor, a low boiling solvent suitable as a devolatilizing aid is preferred. A solvent less viscous than and highly immiscible in the viscous material is preferred if separation is to take place in a rotary phase separating processor and the solvent vapor pressure is preferably sufficiently high to avoid flashing at the phase separating temperature and pressure.

Details relating to the novel liquid-liquid extracting apparatus and methods of this invention as well as the advantages derived therefrom will be more fully appreciated from the Detailed Description of the Preferred Embodiments taken in connection with the Drawings.

DETAILED DESCRIPTION OF THE PREFERRED EMBODIMENTS

Figure 1:
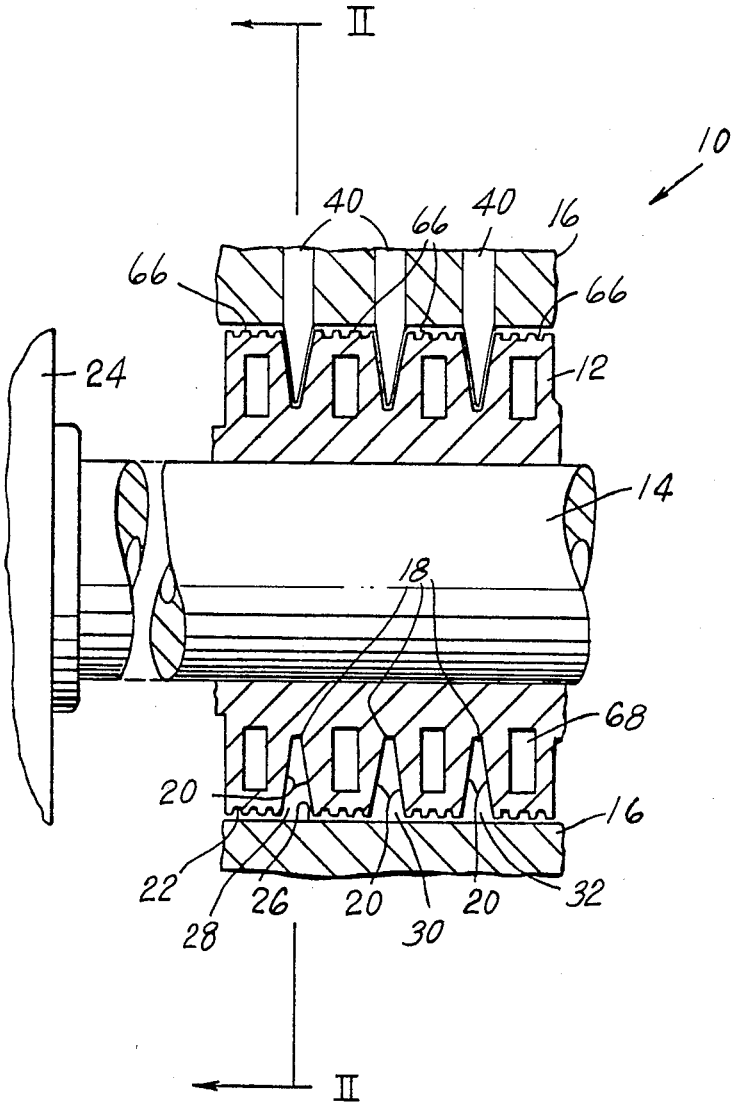
FIG. 1 is a simplified cross-sectional view of a mixing processor of one embodiment of the invention, taken along line I—I of FIG. 2.
Figure 2:
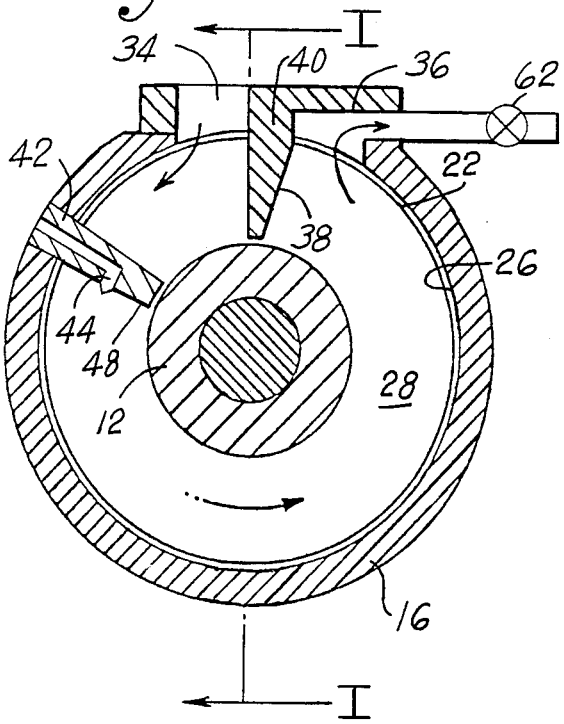
FIG. 2 is a simplified cross-sectional view of the processor of FIG. 1, taken along line II—II of FIG. 1.
Figure 3:
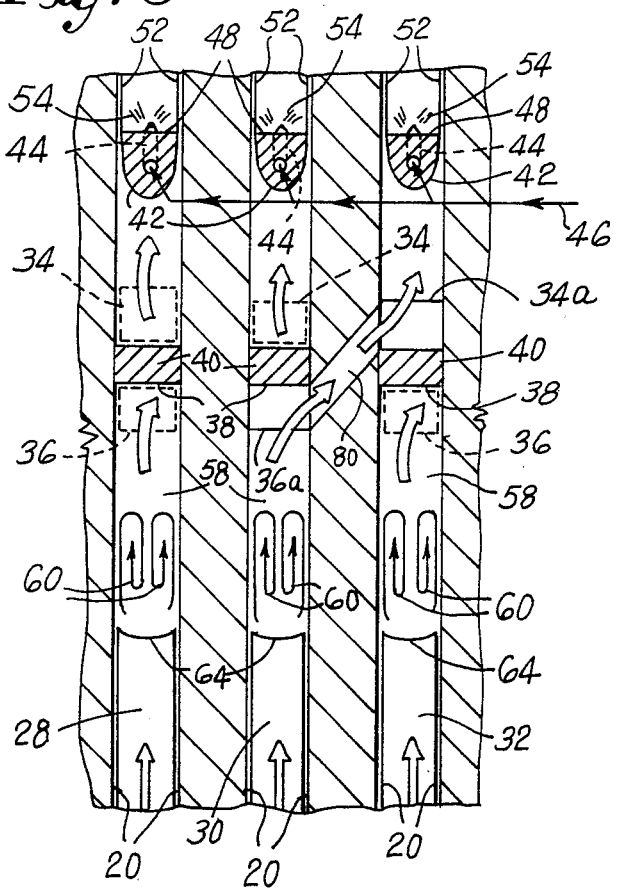
FIG. 3 is a simplified schematic view of a processing passage of the processor of FIG. 1, with arrows indicating the flow direction of material through the passage, and schematically illustrating the spray means for introducing solvent liquid to the passage.

Referring first to FIGS. 1–3, novel mixing processor 10 of one embodiment of extracting apparatus according to the invention includes rotor 12 mounted on drive shaft 14 for rotation within a stationary. element comprising housing 16. Rotor 12 carries mixing channels 18 each having opposed side walls 20 extending inwardly from rotor surface 22. Means 24 for rotating rotor 12 may be of any suitable type commonly used for rotating extruders or similar processing apparatus and are well known to those skilled in the art. Housing 16 provides coaxial closure surface 26 cooperatively arranged with surface 22 of rotor 12 to form with channels 18 enclosed mixing passages 28, 30 and 32. Representative passage 28 as shown in FIG. 2, includes inlet 34 and outlet 36, formed in housing 16. Stationary member 40, associated with housing 16, fits closely within channel 18 and provides end wall 38 for the passage. A blocking member, shown in FIGS. 2 and 3 as spreader 42, extends into the passage between inlet 34 and end wall 38. In operation, viscous liquid material entering the passage through inlet 34 is carried by rotating side walls 20 past spreader 42 and toward end wall 38 for collection as a recirculating pool and pressurization induced by the continued rotation of side walls 20 past the pool for discharge from the passage through outlet 36. The pressurization of viscous material at the stationary end wall of a rotating annular channel and the discharge through an outlet is described in detail in U.S. Pat. Nos. 4,142,805 and 4,194,841 referenced above.

FIGS. 2 and 3 illustrate a preferred means for introducing solvent liquid to the passage for mixing with the viscous material. Spreader 42, associated with housing 16, extends into channel 18 to block at least some of the material entering passage 28 and spread the material onto side walls 20 of the passage to be carried toward end wall 38 as films on the side walls. Spray means 44 for introducing solvent liquid to the passage is illustrated in FIGS. 2 and 3 as a conventional conduit and spray nozzle assembly arranged to receive solvent from solvent supply means 46, normally positioned outside of the housing. In a preferred arrangement, spray means 44 is carried by spreader 42 with the spray nozzle positioned at or near downstream surface 48 of spreader 42. In operation, as illustrated in FIG. 3, material entering the passage at inlet 34 is collected upstream of spreader 42 and is spread as films 52 on rotating side walls 20 of the passage. Solvent liquid from supply means 46 is introduced to the passage through spray means 44 and is sprayed onto films 52, as shown at 54, to be carried with films 52 toward end wall 38 to be collected with the viscous material as recirculating pool 58. The solvent and the proportion of solvent to viscous material are selected to remove at least a portion and preferably a major portion of the impurities from the material, as described above. In pool 58 a vigorous mixing action is effected, as shown by arrows 60, by the continued rotation of side walls 20 past the recirculating pool. This mixing action finely disperses the solvent liquid in the viscous material, ensuring good contact for mass transfer of the impurities from the viscous material to the solvent. The heterogeneous mixture of viscous material and solvent liquid is pressurized for discharge from the passage through outlet 36, as described above.

Outlet control means such as valve 62, shown in FIG. 2, may be used to control the size of recirculating pool 58 and thus the angular position of pool boundary 64, shown in FIG. 3, also affecting the residence time, temperature and discharge pressure, and controlling the extent of dispersion of the solvent liquid in the viscous material in recirculating pool 58. Also, although continuous operation of the processor is normally preferred, valve 62 may be used to effect batch processing if desired by closing valve 62 during processing and opening the valve for discharge of the processed material.

Preferably, sealing means such as seals 66 (FIG. 1) are provided on rotor surface 22 to prevent leakage of pressurized material from the passage through the clearance between rotor surface 22 and closure surface 26. The temperature of the material within the passages maybe controlled such as by temperature control means 68 (FIG. 1), which is a series of chambers within rotor 12 and/or elsewhere in the processor, through which a heat transfer fluid maybe circulated in known manner to provide heating or cooling of the material in the passages. Details relating to examples of suitable sealing means 66 and heating means 68 can be found in U.S. Pat. Nos. 4,142,805; 4,194,841; 4,207,004; 4,289,319 and 4,300,842, referenced above.

Figure 4:
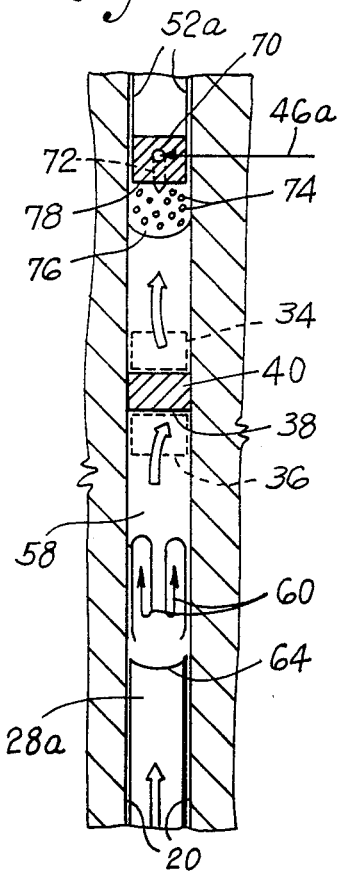
FIG. 4 is a simplified schematic view similar to FIG. 3 of a processing passage of an alternate embodiment of the invention schematically illustrating a sparging means for introducing solvent liquid to the passage.

An alternate arrangement of a mixing processor according to the invention is illustrated in FIG. 4, in which representative passage **28*a*, similar to passage 28 illustrated in FIGS. 1–3, is provided with an alternate means to introduce solvent liquid to the passage. In place of the spreader and spray means of passage 28, passage 28*a* of FIG. 4 is provided with blocking member 70 and sparging means 72 comprising a conduit and sparging nozzle assembly. Sparging means 72 is arranged to receive solvent from solvent supply means 46*a* and to sparge this solvent into pool 76 of material collected upstream of blocking member 70, the solvent liquid entering pool 76 in the form of droplets or globules 74. In a preferred arrangement, sparging means 72 is carried by blocking member 70 and discharges the solvent liquid into pool 76 at or near upstream surface 78 of blocking member 70. The rotation of side walls 20 then carries the viscous material and solvent globules 74 past blocking member 70, for example as films 52*a*, toward end wall 38 and recirculating pool 58 for mixing in a manner similar to that described with reference to FIG. 3**.

Rotary mixing processors according to the invention may have a single passage or a plurality of passages. Two or more passages may be arranged to operate in parallel as a single stage, each passage having an inlet to receive material from outside the processor and an outlet to discharge material from the processor, as illustrated in FIGS. 2 and 3 for passage 28 of processor 10. Alternatively, the passages maybe arranged to operate in series or in a combination of series and parallel operation, providing multi-stage operation for the extracting apparatus.

For example, for some materials or for some processing conditions it may be desirable to introduce the solvent liquid into the mixing passage and mix the solvent with the material two or more times in series for more complete dispersion before the solvent containing the impurities is separated from the mixture. Such an arrangement is shown schematically in FIG. 3, in which mixing passages 30 and 32 of processor 10 are interconnected by material transfer groove 80. Material transfer groove 80 is formed in the closure surface, extending from a point near end wall 38 of passage 30 to passage 32, and provides outlet 36*a* for passage 30 and inlet 34*a* for passage 32.

In operation, viscous liquid material is introduced to passage 30 at inlet 34 and is spread by spreader 42 as films 52 on side walls 20 of passage 30 to be carried toward end wall 38 for collection and mixing. Spray means 44 of passage 30 sprays solvent liquid onto films 52 to be carried with the films toward end wall 38 and dispersed in the viscous material in recirculating pool 58. The resulting mixture is pressurized for discharge through outlet 36*a* and transferred to passage 32 through material transfer groove 80. The mixture enters passage 32 through inlet 34*a* and is spread by spreader 42 as films on side walls 20 of passage 32 to be carried toward end wall 38 for collection and mixing. Spray means 44 of passage 32 sprays additional solvent liquid onto films 52 of mixture to be carried with the films toward end wall 38 and dispersed in the viscous material in recirculating pool 58. The mixture of viscous material and solvent is pressurized for discharge from passage 32 through outlet 36.

In like manner, two or more passages similar to passage 28*a* (FIG. 4), each arranged for sparging the solvent liquid into material collected behind blocking member 70, may be interconnected by a material transfer groove similar to transfer groove 80 shown in FIG. 3 for in-series sparging and dispersing of solvent liquid in the viscous material.

As described above, following the dispersing of solvent within the viscous material and extraction or transfer of at least a portion of the impurities from the viscous material to the solvent, the solvent must be separated from the mixture. A preferred means for carrying out this separation is described in detail in commonly owned U.S. application Ser. No. 685,057, filed on the same day as this application by P. S. Mehta and incorporated herein by reference. As described above above, the use of a phase separating processor to separate solvent from the mixture involves the selection for the mixing step of a solvent less viscous than and immiscible in the viscous material.

Figure 5:
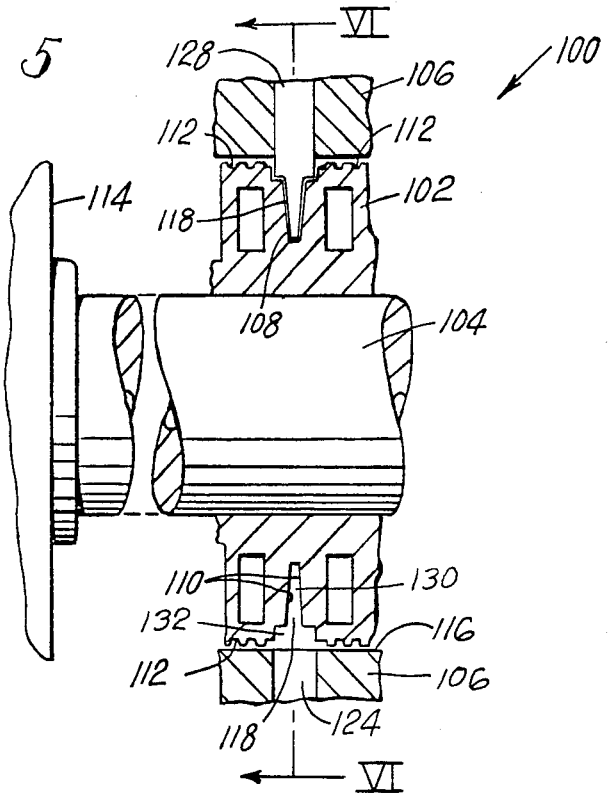
FIG. 5 is a simplified cross-sectional view of a rotary processor which may be used to separate material discharged from a passage such as that shown in FIG. 3 or FIG. 4.
Figure 6:
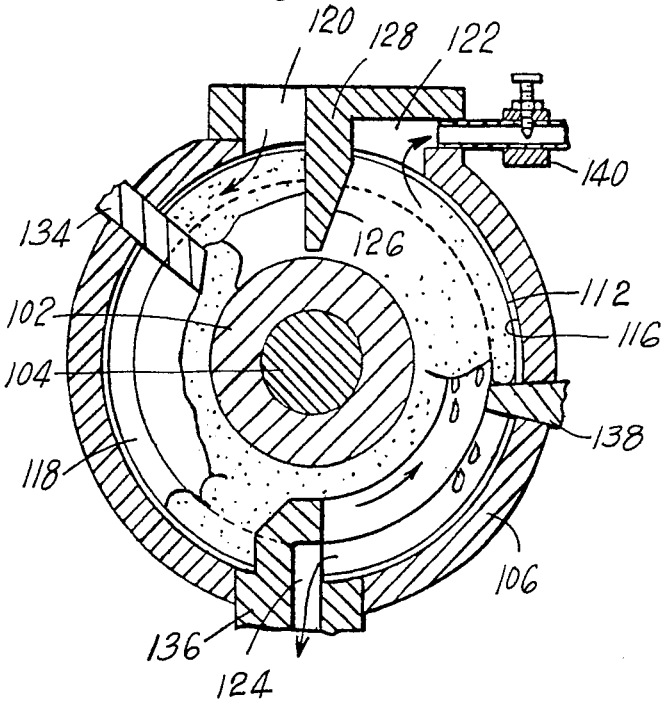
FIG. 6 is a simplified cross-sectional view of the rotary processor of FIG. 5, taken along line VI—VI of FIG. 5.

FIGS. 5 and 6 illustrate one embodiment of separating rotary processors of application Ser. No. 685,057 filed 12-20-84. As shown there, separating processor 100 includes rotor 102 mounted on drive shaft 104 for rotation within a stationary element comprising housing 106. Rotor 102 carries separating channel 108 having opposed side walls 110 extending inwardly from rotor surface 112. Means 114 for rotating rotor 102 maybe of any suitable type commonly used for rotating extruders or similar processing apparatus and are well known to those skilled in the art. Housing 106 provides coaxial closure surface 116 cooperatively arranged with surface 112 of rotor 102 to form with channel 108 enclosed separating passage 118. Inlet 120, outlet 122 and drainage opening 124 for the passage are formed in housing 106. Drainage opening 124 may be arranged for gravitational drainage, as shown in FIG. 6, or for other conventional drainage. Surface 126 of stationary blocking member 128, which is associated with housing 106, fits closely within channel 108 and provides an end wall for the passage. A preferred arrangement for passage 118 is illustrated in FIG. 5, in which channel 108 has a T-shaped cross-sectional configuration providing radially inward passage portion 130 and radially outward passage portion 132. Outward portion 132 is significantly wider than inward portion 130, facilitating drainage of the less viscous solvent liquid from passage 118. End wall surface 126 is also T-shaped in cross-section, fitting closely within channel 108.

Preferably, one or more flow directors, as flow directors 134 and 136, are provided to redirect the material being dragged through the passage radially inward. Flow directors 134 and 136 are preferably shaped to fit closely within channel 108, and preferably extend radially inward into the passage to a depth just sufficient to ensure that the material entering the passage will be dragged toward the end wall by inward passage portion 130, without causing excessive pressurization or material buildup upstream of the flow directors. Downstream flow director 136 may be adapted to provide drainage opening 124, as illustrated in FIG. 6. If necessary, blocking member 138 may be arranged to fit closely within outward passage portion 132 to control the upstream extent of the recirculating pool within outward portion 132. Outlet control means, such as valve 140 (FIG. 6), may be provided at outlet 122.

In operation, a heterogeneous mixture of a viscous liquid material and a dispersed solvent liquid enters separating passage 118 (FIGS. 5 and 6) at inlet 120, is redirected radially inward by flow director 134 and is dragged by rotating sidewalls 110 toward flow director 136. At flow director 136, any material "sagging" away from inward passage portion 130 is redirected toward inward passage portion 130. From flow director 136, the material is dragged forward through inward passage portion 130 toward end wall 126, where the material is blocked and collected to form a recirculating pool. In the recirculating pool, momentum is transferred preferentially to the viscous material by the dragging action of the rotating side walls on the viscous material. Additionally, pressure is induced within the material by the continuing rotation of side walls 110 past the blocked material in the pool, reaching maximum pressure at end wall 126. The momentum and pressure induced within the material in the recirculating pool results in separation of the less viscous solvent liquid from the mixture in a manner described in detail in above-referenced application Ser. No. 685,057, filed 12-20-84. The solvent liquid separated from the material forms a continuous phase upstream of the recirculating pool and is discharged from the passage through drainage opening 124. The viscous liquid material remaining in the pool and approaching outlet 122 is discharged from the passage through the outlet. The size of the recirculating pool collected at end wall 126 and the pressure within the pool as well as the degree of separation of solvent liquid from the mixture in the pool may be controlled by adjusting valve 140 at outlet 122. As described in detail in application Ser. No. 685,057 filed 12-20-84, sealing means and/or temperature control means may be provided for separating processor 100.

Alternative separating means for the mixture of solvent and viscous material may be provided by devolatilizing rotary processors. As described above, the use of a devolatilizing processor to separate solvent from the mixture involves the selection for the mixing step of a low boiling solvent suitable as a devolatilizing aid. Such processors are described in above-referenced U.S. Pat. Nos. 4,255,059; 4,329,065 and 4,413,913 and in above-referenced application Ser. No. 532,166. U.S. Pat. Nos. 4,255,059; 4,329,065 and 4,413,913 and application Ser. No. 532,166 are incorporated herein by reference. Alternatively, other, conventional separating means may be used.

Figure 7:
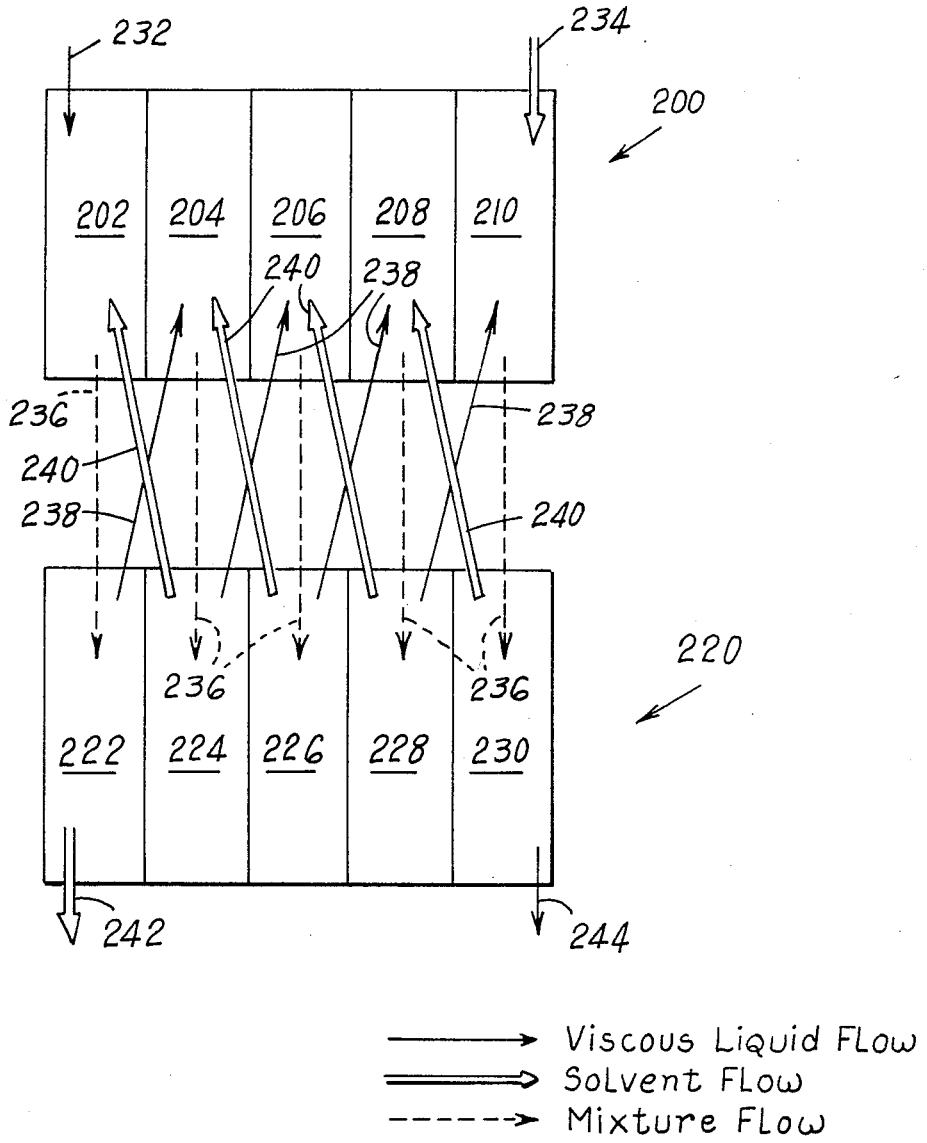
FIG. 7 is a simplified, diagrammatic presentation of a preferred embodiment of the invention arranged for liquid-liquid extraction with countercurrent recycling of the solvent liquid.

FIG. 7 illustrates schematically a preferred, multistage arrangement of extracting apparatus according to the invention. Mixing processor 200, which may be of the type illustrated in FIGS. 1 and 2, and in FIG. 3 for passage 28, provides a plurality of mixing passages, 202, 204, 206, 208 and 210. Separating processor 220, preferably mounted parallel to mixing processor 200, provides a plurality of separating passages, 222, 224, 226, 228 and 230. Each separating passage is preferably of the type illustrated in FIGS. 5 and 6. Alternatively, the separating processor may comprise a multi-stage devolatilizing rotary processor or other, conventional separating means. Conventional material transfer means such as conduits (represented by arrows 236, 238 and 240 of FIG. 7) interconnecting the inlets and outlets of associated passages of the two processors may be provided to transfer material between the passages of processors 200 and 220. Viscous liquid material containing one or more dissolved impurities is introduced to passage 202, the most upstream passage of mixing processor 200, as indicated by arrow 232. A solvent liquid, which is selected to preferentially dissolve one or more of the impurities in the viscous material, is introduced to passage 210, the most downstream passage of mixing processor 200, as indicated by arrow 234, for countercurrent flow through the processors. Arrows 236, 238 and 240 indicate the transfer of the various materials between mixing processor 200 and separating processor 220. Arrows 236 represent the transfer of the mixture of viscous material and solvent liquid from each mixing passage to a corresponding separating passage of separating processor 220. Arrows 238 represent the transfer of viscous material separated in each separating passage (except the most downstream separating passage) to a downstream mixing passage. Arrows 240 represent the transfer of solvent liquid separated from the mixture in each separating passage (except the most upstream separating passage) to an upstream mixing passage. Solvent carrying impurities extracted from the viscous material is discharged from (most upstream) separating passage 222, as indicated by arrow 242. Purified viscous liquid material is discharged from (most downstream) separating passage 230, as indicated by arrow 244.

In operation, viscous liquid material entering mixing passage 202 is mixed with solvent liquid transferred to passage 202 from separating passage 224, to disperse the solvent liquid in the viscous material and extract or transfer a portion of the impurities to the solvent liquid, as described above with reference to FIGS. 1–3. The mixture is pressurized and discharged from passage 202, as described above, and transferred to separating passage 222, utilizing the discharge pressure induced in passage 202 or by conventional pumping menas (not shown). In separating passage 222, the mixture is processed as described above, separating solvent from the mixture and discharging the solvent from the separating processor, as indicated by arrow 242. The remaining viscous material discharged from separating passage 222 is transferred downstream to mixing passage 204 of processor 200, utilizing the discharge pressure induced in passage 222 or by conventional pumping means (not shown). In passage 204, solvent liquid transferred from separating passage 226 is dispersed in the viscous material in the manner described above, the mixture being transferred, as described above for passage 202, from mixing passage 204 to separating passage 224. In separating passage 224, the solvent is separated from the mixture discharged from the passage, collected as a liquid and transferred to mixing passage 202, normally by means of a conventional pump. The remaining viscous material discharged from separating passage 224 is transferred, as described above for passage 222, downstream to mixing passage 206. In mixing passage 206, solvent liquid transferred from separating passage 228 is dispersed in the viscous material, the mixture being transferred, in the manner described above, to separating passage 226. This countercurrent flow continues through the remaining mixing and separating passages until the viscous material enters (most downstream) mixing passage 210 of processor 200. In passage 210, solvent liquid introduced to the passage, as indicated by arrow 234, normally by conventional pumping means, is dispersed in the viscous material transferred from separating passage 228, the mixture being transferred, as described above, to (most downstream) separating passage 230 of processor 220. Solvent liquid separated from the mixture in separating passage 230 is discharged, collected and transferred upstream, normally by conventional pumping means, to mixing passage 208, while purified viscous liquid material is discharged from processor 220, as indicated by arrow 244.

Multistage processors 200 and 220 illustrated in FIG. 7 provide a single mixing passage and a single separating passage for each stage. Alternatively, two or more passages operating in parallel or in series may be provided for the mixing and/or separating portion of each extracting stage. For series operation, internal transfer means similar to material transfer groove 80 (FIG. 3) may interconnect adjacent passages of each stage.

Mixing processor 200 and separating processor 220 are described as providing countercurrent flow between the viscous material and the solvent liquid. Alternatively, mixing passages and separating passages may be arranged for cocurrent flow in a manner similar to that illustrated in FIG. 8. Extracting apparatus comprising mixing and separating processor 300 provides mixing passages 302, 304, 306 and 308 as well as separating passages 310, 312, 314 and 316. Viscous liquid material containing one or more dissolved impurities is introduced to most upstream mixing passage 302, as indicated by arrow 318. Fresh solvent liquid, as indicated by arrows 320, is introduced to each mixing passage in the manner described above and is dispersed in the viscous material in the passage for extraction of impurities from the viscous material. The same type of solvent may be introduced to each mixing passage or, alternatively, one or more different solvents may be introduced to some passages. The mixture of viscous material and solvent liquid discharged from each mixing passage is transferred, as described above for passage 202, to a corresponding separating passage, as indicated by arrows 322. Solvent carrying impurities extracted from the viscous liquid is discharged from each separating passage, as indicated by arrows 324, as described above, while the material remaining in the separating passage is transferred, as described above for passage 222, to a downstream mixing passage as indicated by arrows 326. The purified viscous material is discharged from processor 300, as indicated by arrow 328.

In operation, viscous material entering mixing passage 302 is mixed with fresh solvent liquid to disperse the solvent liquid and extract impurities, as described with reference to FIGS. 1 thru 4. The mixture of material is discharged from mixing passage 302 and is transferred to separating passage 310. In separating passage 310, the mixture is separated as described above, the solvent carrying impurities being discharged from passage 310 and the remaining viscous material being transferred downstream to mixing passage 304. In passage 304 the viscous material is again mixed with fresh solvent liquid in a manner similar to that occurring in passage 302, the mixture being transferred to corresponding separating passage 312. In passage 312 solvent carrying impurities is separated from the mixture and is discharged from the passage. The remaining viscous material is transferred downstream to mixing passage 306 and is mixed with fresh solvent liquid introduced to the passage. The mixture is then transferred to corresponding separating passage 314. Solvent carrying impurities is separated from the mixture and discharged from passage 314 while the remaining viscous material is transferred downstream to mixing passage 308. In passage 308 the viscous material is again mixed with fresh solvent liquid introduced to the passage, the mixture being transferred downstream to separating passage 316. The solvent separated from the mixture in passage 316 is discharged from the passage, while the purified viscous material is discharged from processor 300.

Figure 8:
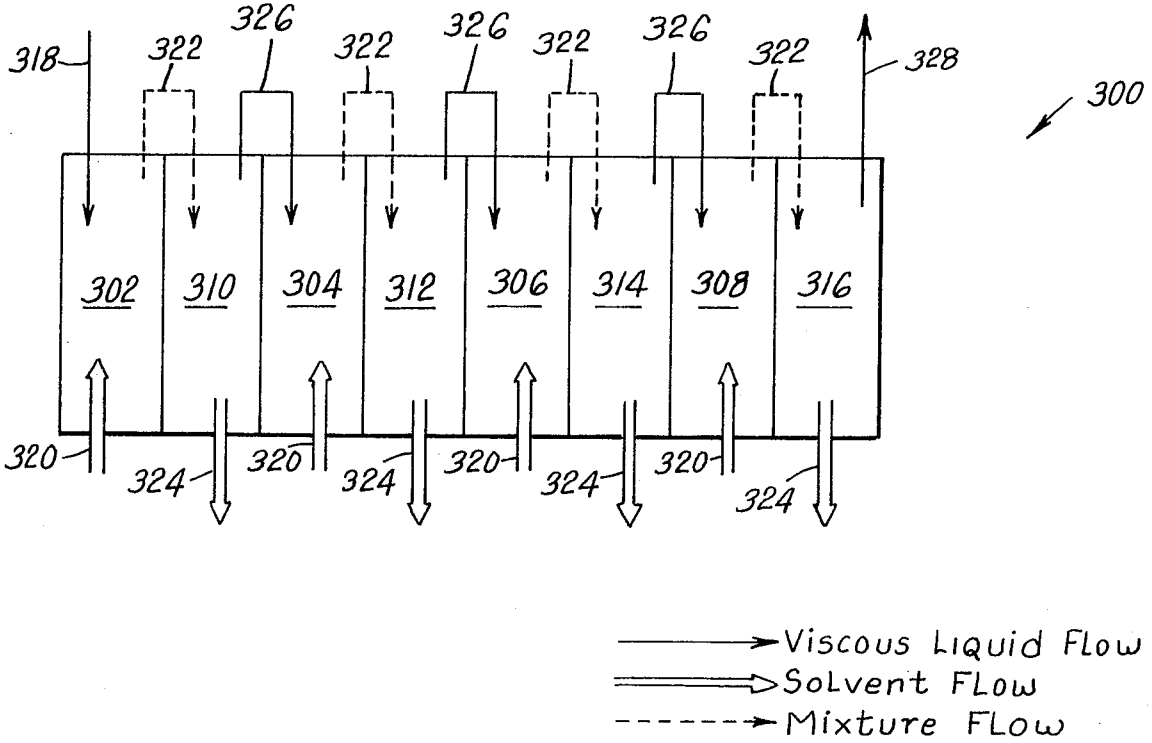
FIG. 8 is a simplified diagrammatic representation of another preferred embodiment of the invention, illustrating an alternating arrangement of purifying and separating passages carried on a single rotor.

The successive mixing and separating stages illustrated in FIG. 8 each comprise one passage. Alternatively, two or more passages operating in parallel or in series may be provided for any one or more of the mixing and/or separating stages. Also, FIG. 8 illustrates a single processor on a common rotor providing both mixing and separating passages operating in series, with material being transferred cocurrently downstream. Preferably, internal transfer means similar to internal transfer groove 80 (FIG. 3) interconnect the passages of processor 300. Alternatively, cocurrent flow of viscous material and solvent may be provided by a mixing processor and a separating processor each carried on a separate rotor, similar to the arrangement illustrated in FIG. 7. Likewise, the mixing passages and separating passages carried on a single rotor, as illustrated for processor 300, may be interconnected for countercurrent flow, in a manner similar to that illustrated in FIG. 7, preferably by providing a combination of internal material transfer means and external conduits. Although the preferred separating means are phase separating passages similar to those illustrated in FIGS. 5 and 6, alternate arrangments of phase separating passages may be provided or, as mentioned above, devolatilizing passages may be use to separate solvent carrying impurities from the viscous material. In the latter method of separation, condensor means (not shown) may be provided to condense solvent vapor for transfer.

It should be understood that the invention is not intended to be limited by what has been particularly shown and described but only as indicated in the accompanying claims. Accordingly, the invention presents to the art novel, energy efficient rotary processors and methods for purifying viscous liquid materials, such as polymers or oils, by removing one or more dissolved impurities by liquid-liquid extraction.

I claim:

1. A method for purifying a viscous liquid material by extracting one or more impurities dissolved in the material comprising:

A. introducing the material containing the impurities at a feed point to one or more substantially annular mixing zones each defined by two rotatable, substantially circular walls, a stationary surface coaxial with the circular walls and enclosing the mixing zone, an end wall positioned downstream of and a major portion of the circumferential distance about the zone from the feed point, and a blocking member positioned between the feed point and the end wall;

B. rotating the circular walls of each mixing zone at substantially equal velocities, in the same direction from the feed point toward the end wall, so that the material introduced at the feed point is dragged forward by the circular walls from the feed point toward the end wall of each mixing zone;

C. partially blocking the downstream movement of the dragged-forward material upstream of the blocking member of each mixing zone and spreading the blocked material on the circular walls of each mixing zone at the blocking member, so that at least a portion of the material is dragged downstream past the blocking member as films on the circular walls of the mixing zone;

D. spraying onto the films of material from a point at or near the blocking member a solvent selected to preferentially dissolve one or more of the impurities contained in the viscous material, in such a way that the solvent is carried downstream with the viscous material, and in a proportion relative to the material sufficient to dissolve at least a portion of the impurities contained in the material;

E. blocking at the end wall the downstream movement of the material and solvent and collecting the material and solvent so that a recirculating pool of material and solvent is formed at the end wall in which the solvent is dispersed in the material and transfer of at least a portion of the dissolved impurities from the viscous liquid material to the solvent is effected;

F. discharging the mixture of the material and the solvent from the mixing zone at a discharge point near the end wall; and G. separating the solvent carrying at least a portion of the dissolved impurities from the viscous mixture.

2. Apparatus for purifying a viscous liquid material by extracting one or more impurities dissolved in the material comprising:

A. a rotatable element comprising a rotor carrying one or more annular mixing channels. each channel having opposed side walls extending radially inwardly from the rotor surface;

B. a stationary element having a coaxial closure surface cooperatively arranged with the channels to provide one or more enclosed mixing passages, each mixing passage having an inlet, a member providing an end wall for the passage and spaced apart from the inlet, an outlet near the end wall, and a blocking member comprising a spreader extending into the mixing channel between the inlet and the end wall and providing a clearance between each of the opposed side wallof the channel and the spreader, all associated with the stationary element and arranged so that viscous material fed to the inlet is dragged forward by the rotating side walls, partially blocked by the spreader, dragged past the spreader, at least a portion of the material being spread as films on the rotating side walls, collected and mixed at the end wall and discharged through the outlet;

C. spray means arranged to introduce to at least one mixing passage a solvent selected to preferentially dissolve one or more of the impurities contained in the viscous material, in such a way that the solvent is sprayed onto the films of material to be carried downstream with the viscous material toward the end wall to be mixed with and dispersed in the viscous material, and in a proportion relative to the viscous material sufficient to dissolve at least a portion of the impurities contained in the material; and D. means to separate the solvent carrying dissolved impurites from the mixture.

3. Apparatus according to claim 2 wherein the spray means includes a conduit through the blocking member interconnecting a solvent supply means and a spray nozzle positioned at a downstream surface of the blocking member.

4. A method for purifying a viscous liquid material by extracting one or more impurities dissolved in the material comprising:

A. introducing the material containing the impurities at a feed point to one or more substantially annular mixing zones each defined by two rotatable, substantially circular walls, a stationary surface coaxial with the circular walls and enclosing the mixing zone, an end wall positioned downstream of and a major portion of the circumferential distance about the zone from the feed point, and a blocking member positioned between the feed point and the end wall;

B. rotating the circular walls of each mixing zone at substantially equal velocities, in the same direction from the feed point toward the end wall, so that the material introduced at the feed point is dragged forward by the circular walls from the feed point toward the end wall of each mixing zone;

C. partially blocking the downstream movement of the dragged-forward material and collecting a portion of the material as a pool of material upstream of the blocking member of each mixing zone;

D. sparging into the pool of material at a point at or near the blocking member a solvent selected to preferentially dissolve one or more of the impurities contained in the viscous material, in such a way that the solvent is carried downstreams with the viscous material, and in a proportion relative to the material sufficient to dissolve at least a portion of the impurities contained in the material;

E. blocking at the end wall the downstream movement of the material and solvent and collecting the material and solvent so that a recirculating pool of material and solvent is formed at the end wall in which the solvent is dispersed in the material and transfer of at least a portion of the dissolved impurities from the viscous liquid material to the solvent is effected;

F. discharging the mixture of the material and the solvent from the mixing zone at a discharge point near the end wall; and G. separating the solvent carrying at least a portion of the dissolved impurities from the viscous mixture.

5. A method according to claim 1 or claim 4 wherein the solvent is low boiling and is selected to serve as a devolatilizing aid and wherein the separation of step G comprises devolatilizing the mixture to remove the solvent and impurities from the mixture.

6. A method according to claim 1 or claim 4 wherein the solvent is immiscible in the viscous material and is less viscous than the viscous material, and wherein the separation of step G comprises the steps of:

(1) introducing the mixture at a feed point to one or more substantially annular separating zones each defined by two rotatable, substantially circular walls, a coaxial stationary surface enclosing the separating zone and having an opening therethrough communicating with the separating zone and arranged for drainage, and an end wall positioned downstream of and a predetermined distance from the drainage opening;

(2) rotating the circular walls of each separating zone at substantially equal velocities, in the same direction from the feed point toward the end wall, so that momentum is transferred from the rotating circular walls preferentially to the viscous material in the zone, causing the viscous material to be moved downstream relative to the solvent;

(3) blocking the downstream movement of the mixture through each separating zone at the end wall and collecting the mixture at the end wall as a recirculating pool in which pressurization of the mixture and separation of at least some of the solvent liquid from the mixture occur;

(4) discharging the separated solvent from each separating zone through the drainage opening; and (5) discharging the remaining material from each separating zone at a discharge point positioned near the end wall.

7. A method according to claim 1 or claim 4 wherein the sequence of steps A-G are carried out two or more times in series to further purify the viscous liquid material.

8. A method according to claim 7 wherein at least one sequence is carried out using a first solvent and at least another sequence is carried out using a second solvent at step D.

9. A method according to claim 7 further comprising the steps of collecting as a liquid the solvent containing the impurities separated from the mixture at step G during at least one sequence and introducing the collected solvent liquid as the solvent liquid introduced at step D of another sequence.

10. A method according to claim 9 wherein the step of introducing the collected solvent liquid comprises introducing the collected solvent liquid as the solvent introduced at step D of a prior sequence.

11. A method according to claim 1 or claim 4 further comprising the step of controlling the temperature of the material during at least a portion of the purifying process.

12. Apparatus for purifying a viscous liquid material by extracting one or more impurities dissolved in the material comprising:

A. a rotatable element comprising a rotor carrying one or more annular mixing channels, each channel having opposed side walls extending radially inwardly from the rotor surface;

B. a stationary element having a coaxial surface cooperatively arranged with the channels to provide one or more enclosed mixing passages, each mixing passage having an inlet, a member providing an end wall for the passage and spaced apart from the inlet, an outlet near the end wall, and a blocking member positioned between the inlet and the end wall, all associated with the stationary element and arranged so that viscous material fed to the inlet is dragged forward by the rotating side walls, partially blocked by the blocking member, a portion of the material being collected upstream of the blocking member as a pool of material, dragged past the blocking member, collected and mixed at the end wall and discharged through the outlet;

C. sparging means arranged to introduce to at least one mixing passage a solvent selected to preferentially dissolve one or more of the impurities contained in the viscous material, in such a way that the solvent is sparged into the upstream pool of material to be carried downstream with the viscous material toward the end wall to be mixed with and dispersed in the viscous material, and in a proportion relative to the viscous material sufficient to dissolve at least a portion of the impurities contained in the material; and D. means to separate the solvent carrying dissolved impurities from the mixture.

13. Apparatus according to claim 12 wherein the sparging means includes a conduit through the blocking member interconnecting a solvent supply means and a sparging nozzle positioned at an upstream surface of the blocking member.

14. Apparatus according to claim 2 or claim 12 wherein the solvent is selected to serve as a devolatilizing aid and wherein the separating means comprises means to devolatilize the viscous material to remove the solvent and impurities from the mixture.

15. Apparatus according to claim 2 or claim 12 wherein the solvent is immiscible in the viscous material and is less viscous than the viscous material, and wherein the separating means comprises:

(1) a rotatable element comprising a rotor carrying one or more annular separating channels, each channel having opposed side walls extending radially inwardly from the rotor surface;

(2) a stationary element having a coaxial closure surface cooperatively arranged with the channels to provide one or more enclosed separating passages, each separating passage having an inlet, a blocking member providing an end wall for the passage and spaced apart from the inlet, an outlet near the end wall, and a drainage opening, all associated with the stationary element; and (3) first transfer means to transfer the mixture from the outlet of at least one processing passage to the inlet of at least one separating passage;

(4) each separating passage being arranged so that momentum is transferred from the rotating channel walls preferentially to the viscous material in the mixture, causing the viscous material to be moved downstream relative to the solvent, and so that pressurization of the mixture and separation of at least some of the solvent from the mixture occur, the separated solvent draining from the passage through the drainage opening and the viscous material being discharged from the passage through the outlet.

16. Apparatus according to claim 15 further comprising means for controlling the temperature of the material in at least a portion of the apparatus.

17. Apparatus according to claim 15 in which a plurality of first transfer means are each arranged to transfer the heterogeneous mixture discharged from the outlet of one mixing passage to the inlet of a corresponding separating passage and further comprising second transfer means to transfer the separated viscous material discharged from each separating passage except the most downstream separating passage to a downstream mixing passage so that solvent may be sequentially dispersed in the viscous material and separated two or more times in series.

18. Apparatus according to claim 17 further comprising means to collect and transfer the solvent drained from each separating passage except the most upstream separating passage to an upstream mixing passage so that the flow of solvent liquid is generally countercurrent to the flow of viscous material.

19. Apparatus according to claim 17 in which the mixing channels and the separating channels are arranged in alternating succession on the same rotor and in which the first transfer means comprise a material transfer groove to interconnect each mixing passage to a downstream adjacent separating passage and in which the second transfer means comprise a material transfer groove to interconnect each separating passage except the most downstream separating passage to a downstream adjacent mixing passage so that the solvent liquid may be dispersed in the viscous material and separated two or more times in series, each material transfer groove being formed in the closure surface and extending from a point near the end wall of the more upstream passage to the more downstream passage and providing the outlet for the more upstream passage and the inlet for the more downstream passage.

20. Apparatus according to claim 15 in which the mixing channel(s) and the separating channel(s) are carried on the same rotor and are enclosed by the same closure surface.

21. Apparatus according to claim 15 in which the mixing channel(s) and the separating channel(s) are carried on separate rotors and are enclosed by separate closure surfaces.

22. Apparatus according to claim 2 or claim 12 further comprising at least one material transfer groove interconnecting at least one adjacent pair of passages for in-series operation, each material transfer groove being formed in the closure surface and extending from a point near the end wall of the more upstream passage to the more downstream passage and providing the outlet for the more upstream passage and the inlet for the more downstream passage.

23. Apparatus according to claim 2 or claim 12 further comprising means for controlling the temperature of the material in at least a portion of the apparatus.

* * * * *